US007356292B2

(12) United States Patent
Kumar et al.

(10) Patent No.: US 7,356,292 B2
(45) Date of Patent: Apr. 8, 2008

(54) ELECTROSTATOGRAPHIC DEVELOPER UNIT HAVING MULTIPLE MAGNETIC BRUSH ROLLS WITH A MAGNETIC RESTRICTOR FOR CARRIER PARTICLE EMISSION CONTROL

(75) Inventors: Ajay Kumar, Fairport, NY (US); Keith Allan Nau, Webster, NY (US); David A. Reed, Rochester, NY (US); Hirotsugu Oba, Webster, NY (US); Jonathan David Sadik, Rochester, NY (US); Richard L. Kjar, Penn Yan, NY (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 11/453,636

(22) Filed: Jun. 15, 2006

(65) Prior Publication Data

US 2007/0292166 A1 Dec. 20, 2007

(51) Int. Cl.
*G03G 15/09* (2006.01)

(52) U.S. Cl. ..... 399/269

(58) Field of Classification Search ..... 399/104, 399/267, 269, 277; 347/140, 158
See application file for complete search history.

(56) References Cited

U.S. PATENT DOCUMENTS 3,638,614 A * 2/1972 Young et al. ..... 399/269
3,640,248 A * 2/1972 Nielander ..... 399/269
4,048,957 A * 9/1977 Tagawa ..... 399/269
4,436,055 A * 3/1984 Yamashita et al. ..... 399/269
4,465,356 A * 8/1984 Joseph et al. ..... 399/267 X
4,833,504 A * 5/1989 Parker et al. ..... 399/269 X
5,930,569 A * 7/1999 Roof et al. ..... 399/269
6,512,902 B2 1/2003 Kasiske et al.
6,671,473 B2 12/2003 Miyabe
6,876,829 B2 4/2005 Masham
6,968,138 B2 11/2005 Akutsu
6,978,108 B2 * 12/2005 Sakamaki ..... 399/267
7,010,253 B2 * 3/2006 Kakimoto ..... 399/269
7,054,584 B2 * 5/2006 Hirobe ..... 399/269
7,236,727 B2 * 6/2007 Fukuda ..... 399/269

* cited by examiner

*Primary Examiner*—Sandra L Brase
(74) *Attorney, Agent, or Firm*—Maginot Moore & Beck LLP

(57) ABSTRACT

A development station in an electrostatographic imaging machine impedes the flow of carrier particles out of the development station as the developer moves from an upper to a lower magnetic roll. The development station includes a developer housing, for retaining a quantity of developer having semi-conductive carrier particles and toner particles, a first magnetic roll having a stationary core with at least one magnet and a sleeve having longitudinal grooves that rotates about the stationary core of the first magnetic roll to present developer on one side of the first magnetic roll to the photoreceptor, a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls, and a magnetic seal located in the gap between the first and the second magnetic rolls to impede the outflow of carrier particles from the developer moving from the first magnetic roll to the second magnetic roll.

21 Claims, 8 Drawing Sheets

ELECTROSTATOGRAPHIC DEVELOPER UNIT HAVING MULTIPLE MAGNETIC BRUSH ROLLS WITH A MAGNETIC RESTRICTOR FOR CARRIER PARTICLE EMISSION CONTROL

CROSS-REFERENCE TO RELATED APPLICATIONS

Reference is made to commonly-assigned co-pending U.S. patent application Ser. No. 11/262,575, entitled "Xerographic Developer Unit Having Multiple Magnetic Bursh Rolls Rotating Against The Photoreceptor," which was filed on Oct. 31, 2005; U.S. patent application Ser. No. 11/262,577 entitled "Xerographic Developer Unit Having Multiple Magnetic Brush Rolls With A Grooved Surface," which was filed on Oct. 31, 2005; U.S. patent application Ser. No. 11/262,576 entitled "Xerographic Developer Unit Having Multiple Magnetic Brush Rolls Rotating With The Photoreceptor," which was filed on Oct. 31, 2005; U.S. patent application Ser. No. 11/263,370 entitled "Variable Pitch Auger To Improve Pickup Latitude In Developer Housing", which was filed on Oct. 31, 2005, and U.S. patent application Ser. No. 11/263,371 entitled "Developer Housing Design With Improved Sump Mass Variation Latitude," which was filed on Oct. 31, 2005, the disclosures of which are incorporated herein.

TECHNICAL FIELD

The present disclosure relates generally to an electrostatographic or xerographic printing machine, and more particularly concerns a development subsystem having multiple developer rolls that delivers semi-conductive developer to a photoreceptor.

BACKGROUND

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

One familiar type of development of an electrostatic image is called "two-component development." Two-component developer material largely comprises toner particles interspersed with carrier particles. The carrier particles may be attracted magnetically and the toner particles adhere to the carrier particles through triboelectric forces. This two-component developer can be conveyed, by means such as a "magnetic roll," to the electrostatic latent image, where toner particles become detached from the carrier particles and adhere to the electrostatic latent image.

In magnetic roll development systems, the carrier particles with the triboelectrically adhered toner particles are transported by the magnetic rolls through a development zone. The development zone is the area between the outside surface of a magnetic roll and the photoreceptor surface on which a latent image has been formed. Because the carrier particles are attracted to the magnetic roll, some of the toner particles are interposed between a carrier particle and the latent image on the photoreceptor. These toner particles are attracted to the latent image and transfer from the carrier particles to the latent image. The carrier particles are removed from the development zone as they continue to follow the rotating surface of the magnetic roll. The carrier particles then fall from the magnetic roll and return to the developer supply where they attract more toner particles and are reused in the development process. The carrier particles fall from the magnetic roll under the effects of gravity or are directed away from the roller surface by a magnetic field.

One type of carrier particle used in two-component developers is the semi-conductive carrier particle. Developers using this type of carrier particle are also capable of being used in magnetic roll systems that produce toner bearing substrates at speeds of up to approximately 200 pages per minute (ppm). Developers having semi-conductive carrier particles use a relatively thin layer of developer on the magnetic roll in the development zone. In these systems an AC electric waveform is applied to the magnetic roller to cause the developer to become electrically conductive during the development process. The electrically conductive developer increases the efficiency of development by preventing development field collapse due to countercharge left in the magnetic brush by the developed toner. A typical waveform applied to these systems is, for example, a square wave at a peak to peak amplitude of 1000 Volts and a frequency of 9 KHz. This waveform controls both the toner movement and the electric fields in the development zone. These systems may be run in a "with" mode, which means the magnetic roll surface runs in the same direction as the photoreceptor surface, or in an "against" mode, which means the magnetic roll surface runs in a direction that is the opposite direction in which the photoreceptor surface runs. The high surface speed at which these magnetic rolls are operated require high strength magnets to control the developer bed. These types of magnets are expensive. Additionally, high speeds also increase the wear on bearings in the developer housing.

Another issue in known magnetic roll systems used with developers having semi-conductive carrier particles is the difficulty in extending the development zone to increase the time in which toner development may occur. One method for increasing development zone length with other developers having insulated or conductive carrier particles is to use two magnetic rolls. The two rolls are placed close together with their centers aligned to form a line that is parallel to the photoreceptor. Because the developer layer for semi-conductive carrier particle developer is so thin, magnetic fields sufficiently strong enough to cause semi-conductive carrier particles to migrate in adequate quantities from one magnetic roll to the other magnetic roll also interfere with the transfer of toner from the carrier particles in the development zones. Consequently, construction of the magnetic rolls requires careful consideration of this interference. If two rolls are not able to be used to increase the development zone, then the radius of the magnetic roll may be increased to accommodate this goal. There is a limit, however, to the diameter of the magnetic roll. One limit is simply the area within the printing machine that is available for a development subsystem. Another limit is the size and strength of the magnets internal to the magnetic roll that are required to provide adequate magnetic field strengths and shapes at the surface of a larger magnetic roll.

To address the issues arising in development systems having two magnetic development rolls, a development station has been implemented that increases the time for developing the toner and provides an adequate supply of developer for good line detail, edges, and solids. The development system includes an upper magnetic developer roller and a lower magnetic developer roller. Both developer rollers have a stationary core with at least one magnet and a sleeve that rotates about the stationary core. A motor coupled to the two magnetic developer rolls drives the rotating sleeves of the magnetic developer rolls in a direction that is against the rotational direction of a photoreceptor to which the two magnetic rolls deliver toner. The two magnetic developer rolls carry semi-conductive carrier particles and toner particles through a development zone formed by the magnetic developer rolls. A trim blade is mounted proximate the upper magnetic developer roll to form a trim gap of approximately 0.5 to approximately 0.75 mm.

This development station architecture has resulted in improved development for electrostatographic imaging machines. Unfortunately, a weakness has been discovered in the two vertical roll architecture described above. The observed weakness relates to the loss of carrier particles as the developer transitions from the upper roll to the lower roll. Specifically, the carrier particles are driven out of the system at the ends of the zone between the two rolls. These escaping particles contaminate the internal components of the imaging machine, particularly, the backer bars, the belt to roll spacer (BRS), and the front panel of the machine.

Previously known development stations have used magnetic seals that are mounted at the ends of a development roller. These magnetic seals are comprised of magnetic materials that generate fields for impeding the outward progression of carrier particles at the ends of the roller. In the two roller vertical architecture, these magnetic seals do not generate adequate fields in the vicinity of the space between the two rollers. Space constraints between the rollers inhibit the extension of the magnetic seals at the ends of the rollers. Consequently, carrier particles escape at the ends of the gap between the two rollers with the attendant issues previously noted.

The system and method discussed below address the loss of carrier particles from development stations having two vertically arranged magnetic developer rolls.

SUMMARY

A development station in an electrostatographic imaging machine reduces the loss of carrier particles at the transition area between two magnetic developer rolls in the station by providing magnetic restrictors at the inboard and outboard ends of the zone. A development station in an electrostatographic imaging machine impedes the flow of carrier particles out of the development station as the developer moves from an upper to a lower magnetic roll. The development station includes a developer housing, for retaining a quantity of developer having semi-conductive carrier particles and toner particles, a first magnetic roll having a stationary core with at least one magnet and a sleeve having longitudinal grooves that rotates about the stationary core of the first magnetic roll to present developer on one side of the first magnetic roll to the photoreceptor, a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls, and a magnetic restrictor located in the gap between the first and the second magnetic rolls to impede the outflow of carrier particles from the developer moving from the first magnetic roll to the second magnetic roll. Such a development station may be installed in an electrostatographic machine to reduce the amount of carrier particles driven out of the system at the ends of the zone between the two rolls. The reduction in the amount of escaping particles reduces the contamination of the internal components in the electrostatographic imaging machine.

DETAILED DESCRIPTION

Figure 1:
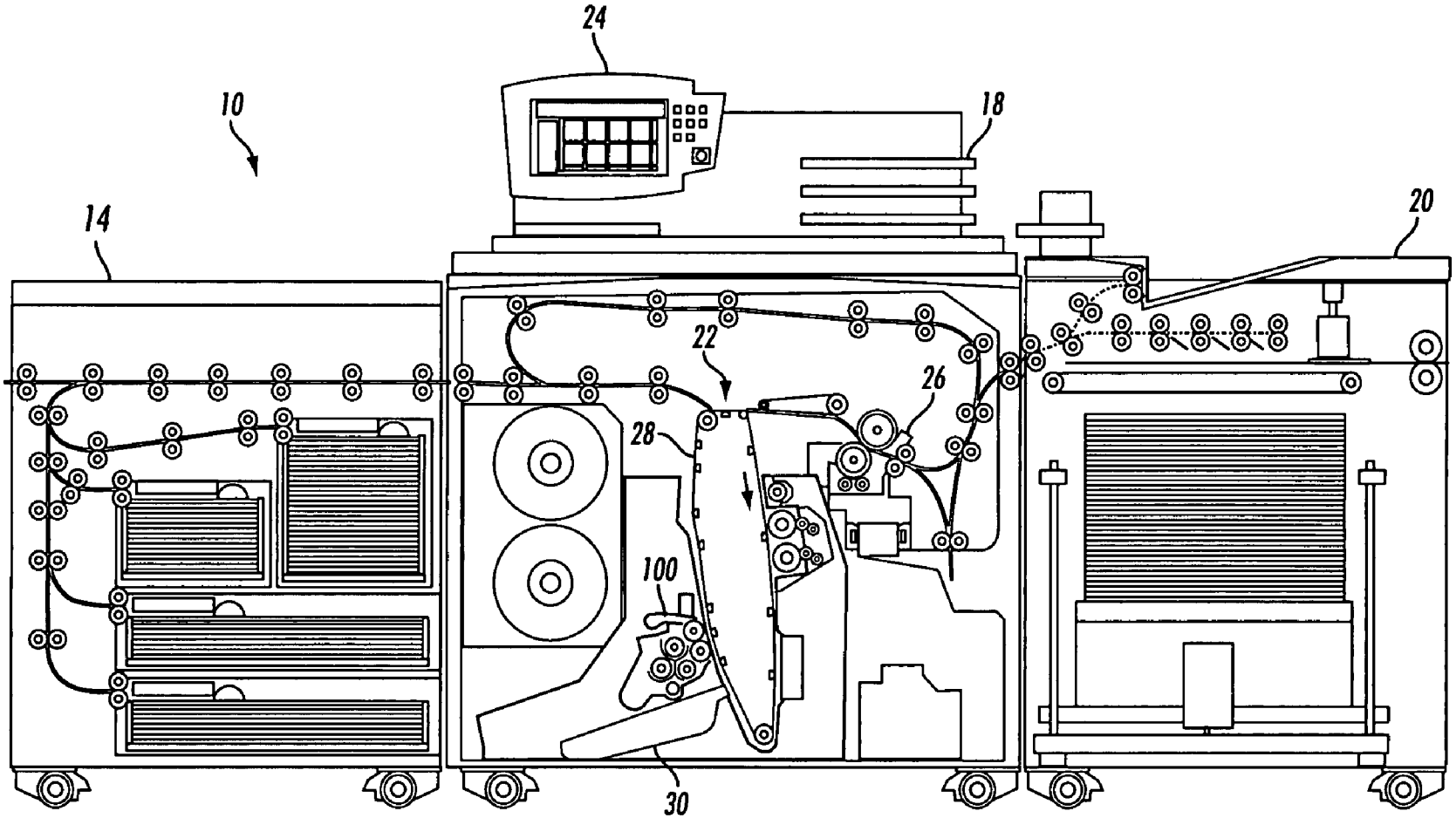
FIG. 1 is an elevational view of an electrostatographic imaging machine incorporating a semi-conductive magnetic brush development (SCMB) system having a magnetic restrictor in the gap between the two magnetic rolls.

FIG. 1 is an elevational view of an electrostatographic imaging machine 10, such as a printer or copier, having a development subsystem that uses two vertically arranged magnetic rolls having a magnetic restrictor in the gap between the rolls. The machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the printing machine 10 or received over an electrical communication link. The page images are used to generate bit data that are provided to a raster output scanner (ROS) 30 for forming a latent image on the photoreceptor 28. Photoreceptor 28 continuously travels the circuit depicted in the figure in the direction indicated by the arrow. The development station 100 develops toner on the photoreceptor 28. At the transfer station 22, the toner conforming to the latent image is transferred to the substrate by electric fields generated by the transfer station.

The substrate bearing the toner image travels to the fuser station 26 where the toner image is fixed to the substrate. The substrate is then carried to the output unit 20. This description is provided to generally describe the environment in which a double magnetic roll development system for developer having semi-conductive carrier particles may be used and is not intended to limit the use of such a development subsystem to this particular printing machine environment.

Figure 2:
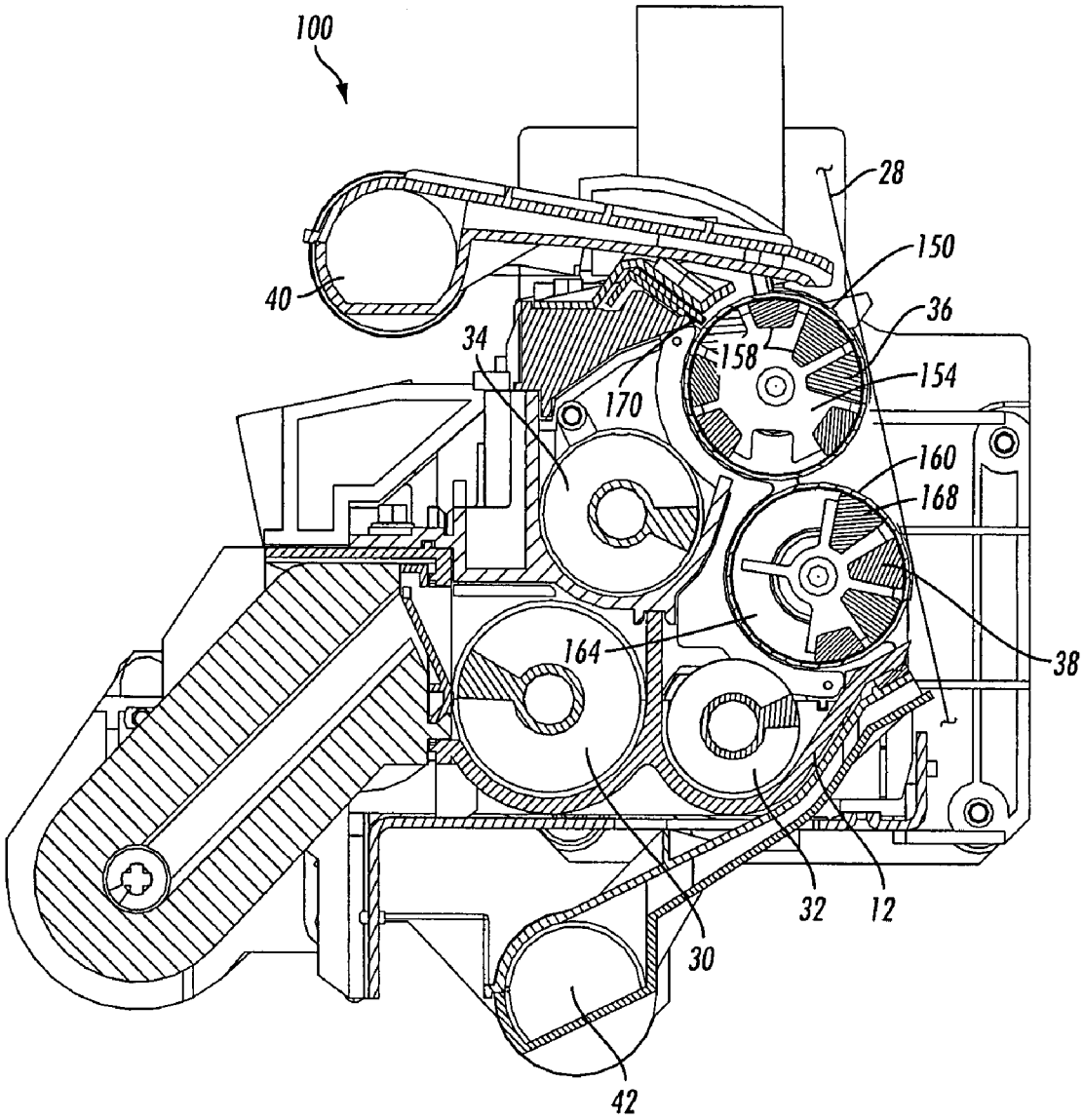
FIG. 2 is a sectional view of a SCMB developer unit having two magnetic rolls with sleeves made from different materials.

The overall function of developer station 100, which is shown in FIG. 2, is to apply marking material, such as toner, onto suitably-charged areas forming a latent image on an image receptor such as the photoreceptor 28, in a manner generally known in the art. The developer station 100, however, provides a magnetic restrictor (FIG. 3) in the gap between the magnetic roll 36 and the magnetic roll 38 to reduce the loss of carrier particles from the development station 100. In various types of printers, multiple developer stations 100 of this construction may be used. For example, one such station may be used for each primary color or other purpose.

Among the elements of the developer station 100, which is shown in FIG. 2, are a housing 12, which functions generally to hold a supply of developer material having semi-conductive carrier particles, as well as augers, such as 30, 32, 34, which variously mix and convey the developer material to the magnetic rolls 36, 38. In the embodiment depicted here, developer from the augers is attracted to the magnetic rolls to form magnetic brushes for applying toner to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, air manifolds 40, 42, are attached to vacuum sources (not shown) for removing dirt and excess particles from the transfer zone near photoreceptor 28. The augers 30, 32, and 34 are configured and cooperate in a manner described in co-pending applications entitled "Variable Pitch Auger To Improve Pickup Latitude In Developer Housing," which was filed on Oct. 31, 2005 and assigned Ser. No. 11/263,370, and "Developer Housing Design With Improved Sump Mass Variation Latitude," which was also filed on Oct. 31, 2005 and assigned Ser. No. 11/263,371, both of which are hereby expressly incorporated herein in their entireties by reference and are commonly assigned to the assignee of this patent application.

As can be seen in this embodiment, the upper magnetic roll 36 and the lower magnetic roll 38 form a development zone that is approximately as long as the two diameters of the magnetic rolls 36 and 38. A motor, not shown, is coupled to the rolls 36 and 38 to cause rotation of the various augers, magnetic rolls, and any other rotatable members within the developer station 100 at various relative velocities. There may be provided any number of such motors. The magnetic rolls 36 and 38 may be rotated in a direction that is opposite to the direction in which the photoreceptor moves past the developer station 100. That is, the two magnetic rolls are operated in the against mode for development of toner, although the magnetic rolls may also be operated in the with mode as well. In one embodiment of the developer station 100, the motor rotates the magnetic rolls at a speed in the range of about 1 to about 1.5 times the rotational speed of the photoreceptor 28. This rotational speed is lower than the rotational speed of magnetic rolls in developer systems that rotate in the same direction as the photoreceptor. That is, the magnetic rolls operated in the against mode may be rotated at lower speeds than magnetic rolls operated in the with mode. These slower speeds increase the life of the magnetic rolls over the life of magnetic rolls that are operated in the with mode to develop toner carried on semi-conductive carrier particles.

As may be observed from FIG. 2, the upper magnetic roll 36 includes a sleeve 150 that is mounted about a stationary core 154 that has at least one magnet 158. Likewise, the lower magnetic roll 38 includes a sleeve 160 that is mounted about a stationary core 164 that has at least one magnet 168. Longitudinal grooves are provided in the surface of the sleeves to impede slippage of developer on the rotating sleeve. A trim blade 170 is mounted in proximity to upper magnetic roll 36 to remove excess developer from the roll 36 before it is carried into the development zone formed by rolls 36 and 38. The trimming operation generates significant stress on the upper roll 36 over the life of the machine. Over the operational life of approximately 20 million images, the longitudinal grooves in the roll 36, and to some degree in roll 38 as well, wear, which causes image quality to degrade unless the rolls are made from a material that is wear resistant.

As discussed above, a two-component developer material is comprised of toner particles and carrier particles. The carrier particles in a two-component developer are attracted to the magnets within the magnetic rolls. The toner particles adhere to the carrier particles by a triboelectrically generated charge. After the toner particles migrate to the photoreceptor as it passes by, the carrier particles are returned to the supply to acquire more toner. Thus, the carrier particles are to remain circulating within the housing 12. Despite the use of magnetic seals mounted at the ends of the rollers, some of the carrier particles escape the development station housing at the gap between the two rolls. To address this leakage of carrier particles, a magnetic barrier has been constructed that impedes the outward progression of carrier particles even though the components are not axially aligned with the ends of the gap, as known magnetic seals are. The magnetic barrier for reducing the loss of carrier particles at the ends of the gap between the rollers, is located at a position that generates magnetic fields that extend across the ends of the gap between the rollers. As these fields impede carrier particles migrating at the ends of the gap, a resulting wall of carrier particles mechanically interferes with the outward movement of other particles and reduces the likelihood that they egress from the development system at the ends of the gap between the rollers.

Figure 3:
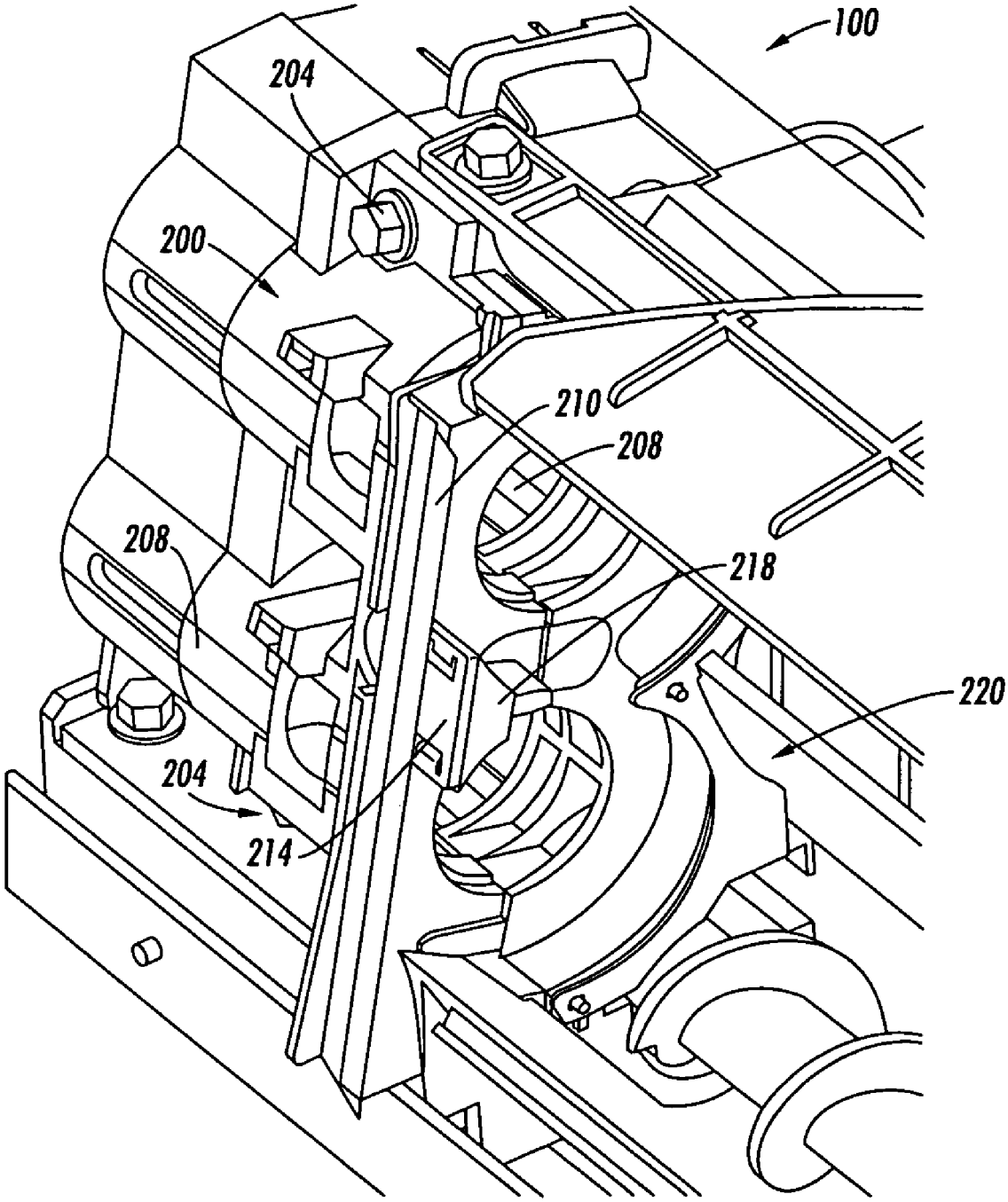
FIG. 3 is a elevational view of a SCMB developer unit without the magnetic rolls to expose the outboard magnetic restrictor.

FIG. 3 is a perspective view of a portion of development station 100 without the magnetic rolls being present. FIG. 3 depicts an outboard cap 200 that is mounted by bolts 204 to the development station 100. The outboard cap 200 includes two arcurate structures 208, which are generally semi-circular, that cover a first set of ends of the magnetic rolls 36 and 38. Coupled to the strip 210 that connects the two structures 208 is a magnet holder 214. The magnet holder 214 secures an outboard magnetic restrictor a position that is proximate the gap 220 between the set of outboard ends for the magnetic rolls 36 and 38. The magnetic fields generated by the magnetic restrictor sufficiently cover the gap between the outboard ends of the magnetic rolls that movement of the carrier particles translating towards the outboard ends is impeded. As the carrier particles accumulate in the area of these magnetic fields generated by the magnetic restrictor, they mechanically block subsequent carrier particles to form a barrier that further impedes the egress of carrier particles from the development station 100.

Figure 4A:
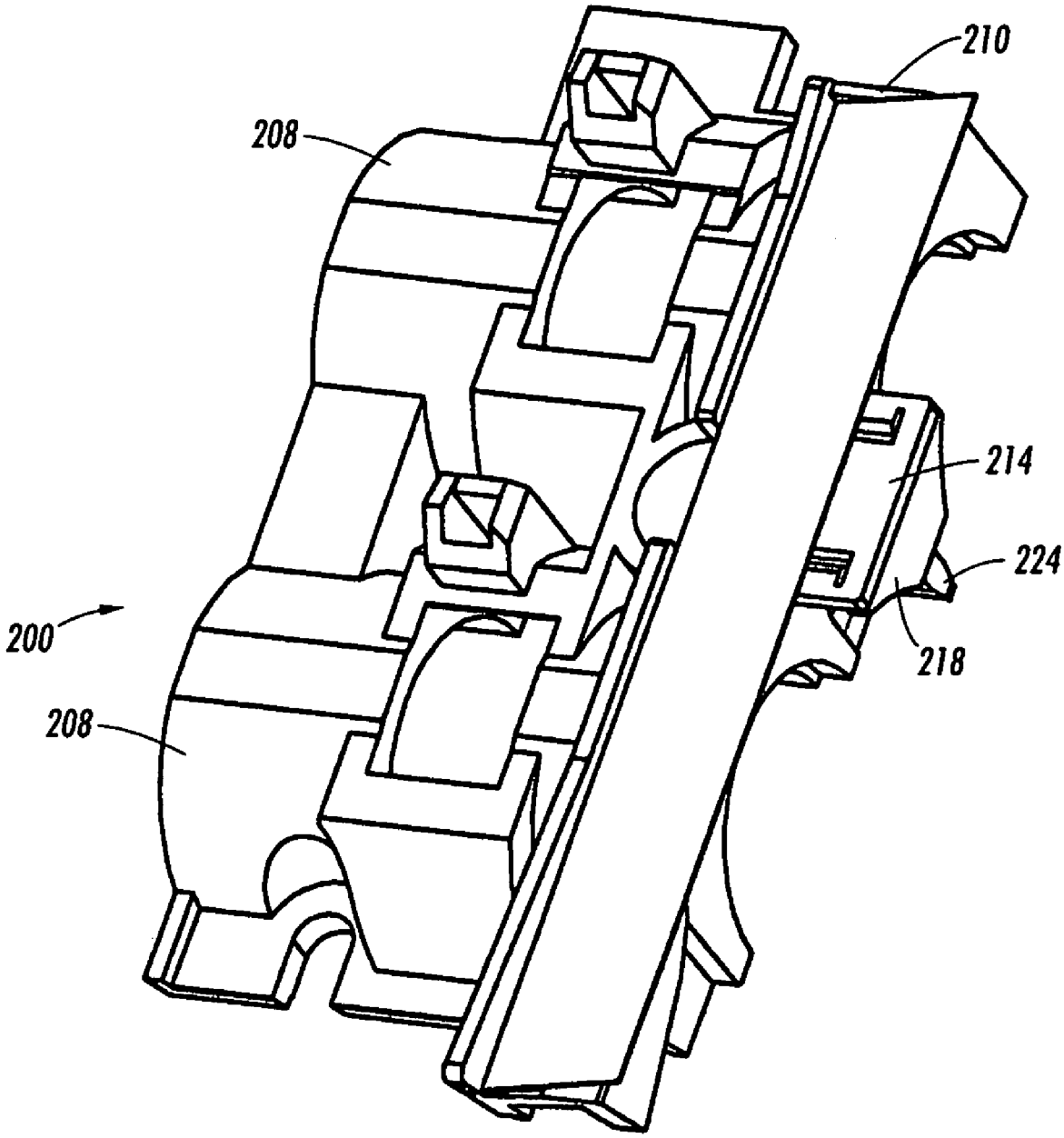
FIGS. 4A and 4B are perspective views of an outboard cap having a magnetic restrictor mounted to it.
Figure 4B:
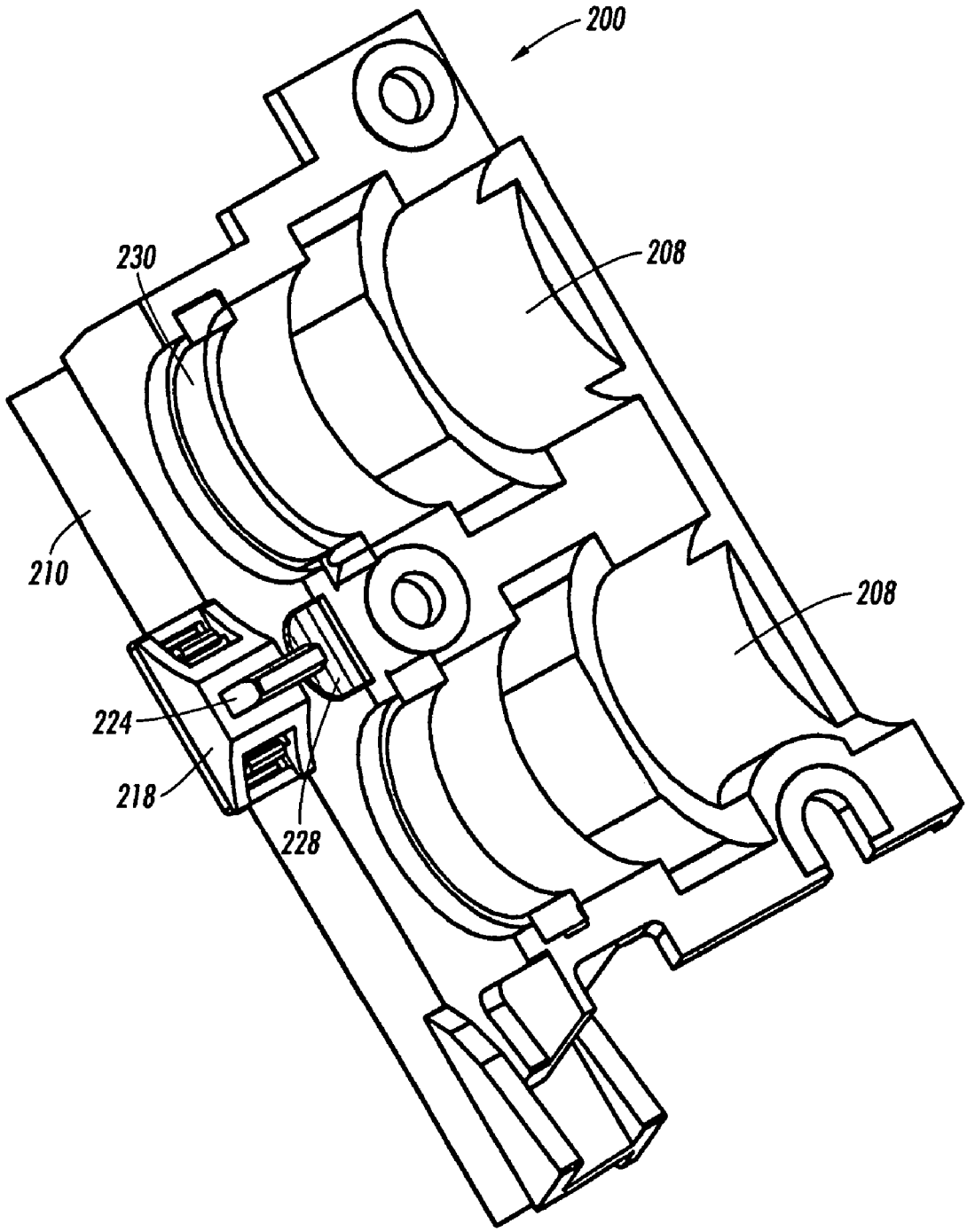

The outboard cap and outboard magnetic restrictor are shown in more detail in FIGS. 4A and 4B. The outboard cap 200 is a molded plastic part that may be configured as shown in FIGS. 4A and 4B. Outboard is used to refer to the end of the magnetic rolls that are nearest a machine user when the user is facing the operator console 24. Inboard is used to refer to the end of the magnetic rolls that is further from the machine user at the same position. That is, the development station 100 is shown from the outboard end in FIG. 1. The exterior of the outboard cap 200 is shown in FIG. 4A and the interior that faces the magnetic rolls 36 and 38 is shown in FIG. 4B. The cap 200 is installed on the side of the magnetic assembly that faces the photoreceptor in an electrostatographic machine.

The arcurate structures 208 accommodate the circumference of the magnetic rolls 36 and 38. As shown in FIG. 4B, recessed circumferential areas 230 are located in the structures 208 near the flange 210. Mounted within these areas 230 are magnetic material that form a magnetic seal at each end of the magnetic rolls 36 and 38. These magnetic seals are formed in a well-known manner.

To address loss of carrier particles from the gap between the magnetic rolls 36 and 38, a magnet holder 218 is mounted to the flange 210. The magnet holder may be mounted by using adhesives, mechanical fasteners, and other known mounting methods. The magnet holder is located on the interior side of the flange 210 so it extends into the cavity in which the magnetic rolls are housed. A center magnet 224 is secured by the magnet holder 218. The center magnet may snap fit into the magnet holder 218, although other securing methods may be used. A magnet end 228 extends from the magnet center at a position that is proximate the gap between the magnetic rolls 36 and 38. The magnetic fields generated by the magnet end 228 impede the movement of carrier particles that may be migrating out of the gap between the magnetic rolls towards and out of the cap. These carrier particles form a mechanical barrier to reduce the likelihood that other carrier particles egress from the gap between the rollers.

Figure 5A:
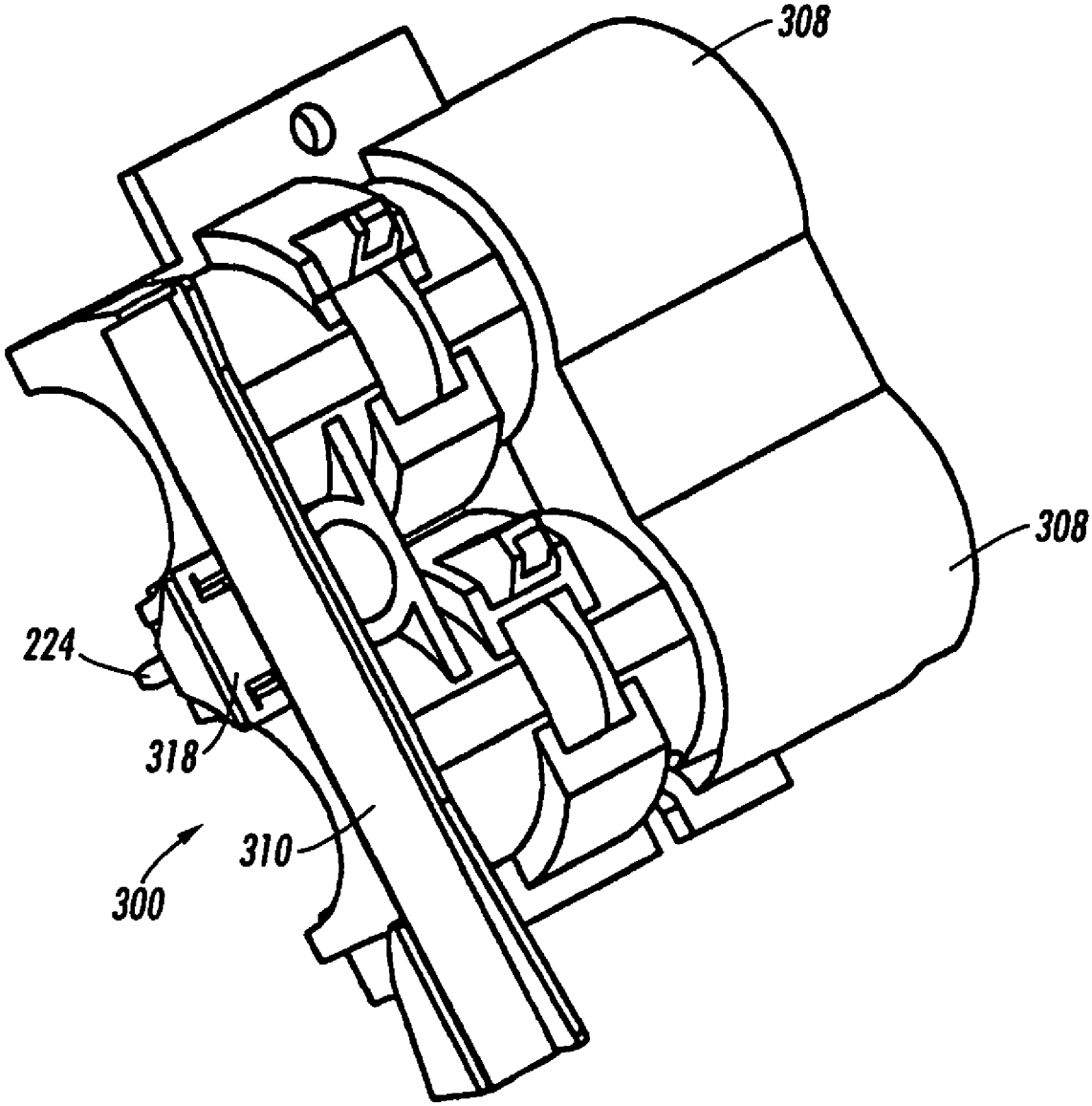
FIGS. 5A and 5B are perspective views of an inboard cap having a magnetic restrictor mounted to it.
Figure 5B:
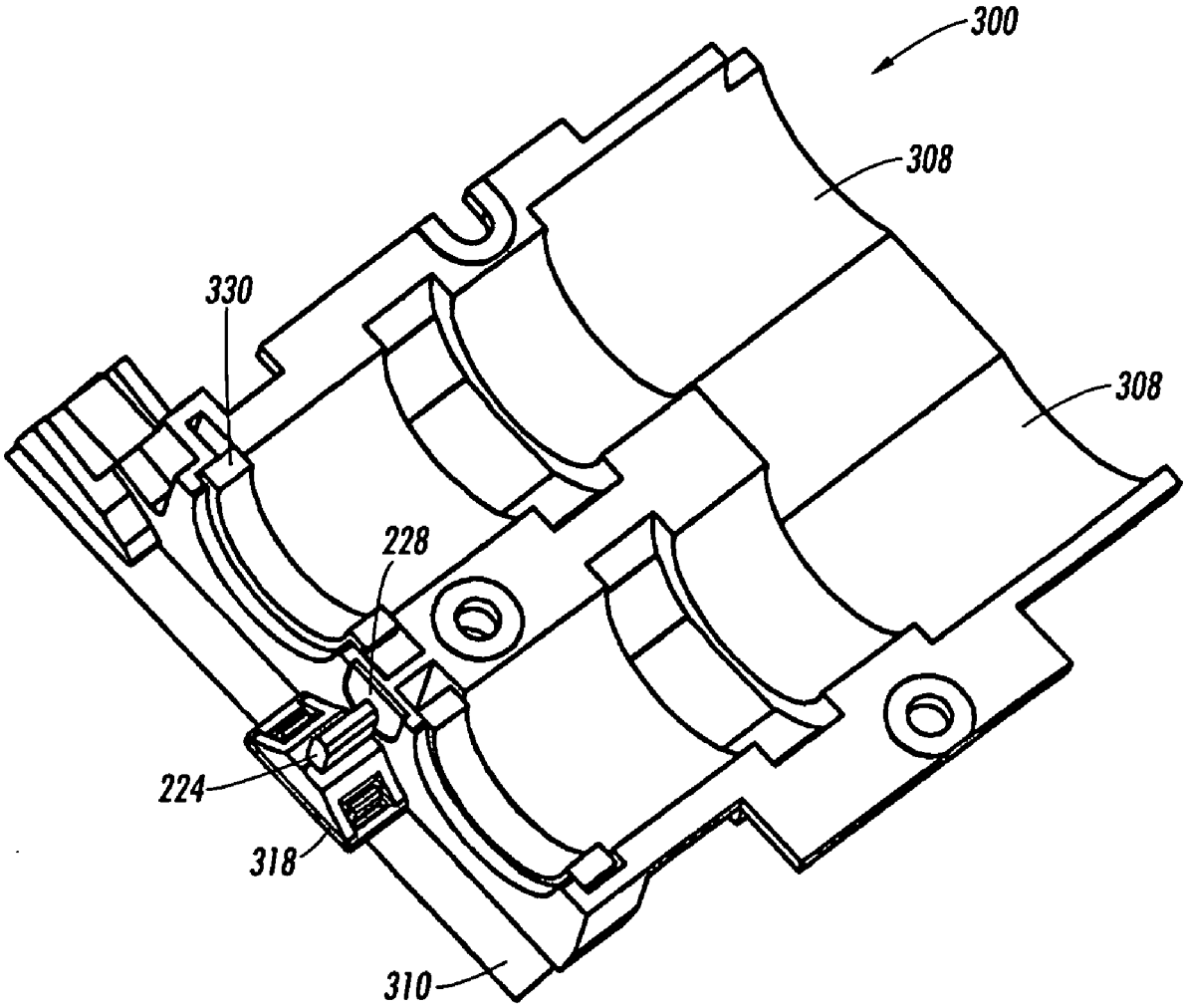

The inboard cap and inboard magnetic restrictor are shown in more detail in FIGS. 5A and 5B. The inboard cap 300 is a molded plastic part that may be configured as shown in FIGS. 5A and 5B. The exterior of the inboard cap 300 is shown in FIG. 5A and the interior that faces the magnetic rolls 36 and 38 is shown in FIG. 5B. The cap 300 is installed on the side of the magnetic assembly that faces the photoreceptor in an electrostatographic machine.

The arcurate structures 308 accommodate the circumference of the magnetic rolls 36 and 38. As shown in FIG. 5B, recessed circumferential areas 330 are located in the structures 308 near the flange 310. Mounted within these areas 330 are magnetic material that form a magnetic seal at each end of the magnetic rolls 36 and 38. These magnetic seals are formed in a well-known manner.

To address loss of carrier particles from the gap between the magnetic rolls 36 and 38, a magnet holder 318 is mounted to the flange 310. The magnet holder may be mounted by using adhesives, mechanical fasteners, and other known mounting methods. The magnet holder is located on the interior side of the flange 310 so it extends into the cavity in which the magnetic rolls are housed. A magnet center 224 is secured by the magnet holder 318. The center magnet may snap fit into the magnet holder 318, although other securing methods may be used. A magnet end 228 extends from the magnet center at a position that is proximate the gap between the magnetic rolls 36 and 38. The magnetic fields generated by the magnet end 228 impede the movement of carrier particles that may be migrating out of the gap between the magnetic rolls towards and out of the cap. These carrier particles form a mechanical barrier to reduce the likelihood that other carrier particles egress from the gap between the rollers. The longer axis of the magnet end 228 may be parallel to the longer axis of the magnet center. The magnet end and the magnet center may be oriented relative to one another to accommodate the space restrictions for locating the magnet end proximate the gap between the rollers.

Figure 6:
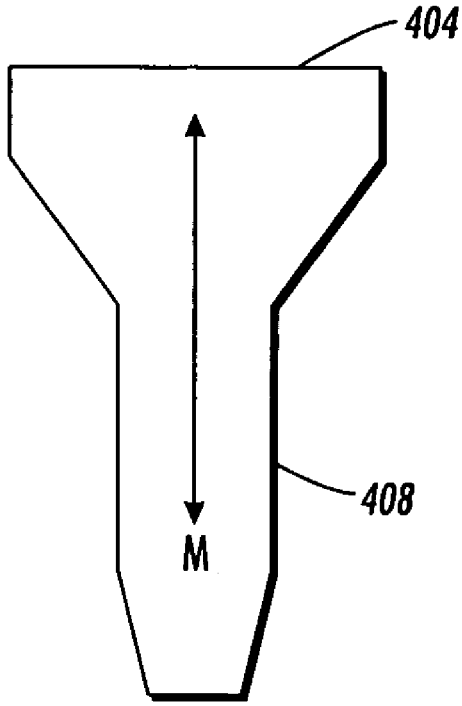
FIG. 6 is a perspective view of an exemplary embodiment of a magnet center used for the magnetic restrictor between the magnetic rolls.

FIG. 6 is a side view of an exemplary embodiment of magnet center 224 and an outline of the magnetic field it generates at a particular field strength. The magnet center 224 includes a base 404 that slants inwardly towards a central magnet member 408. The magnet center may be made of 0.9 MGOe JPM-ZF1110, which is available from known sources for magnetic materials. The magnetic field shown in the figure represents the positions where the field strength should measure 718±35 gauss. This magnetic field impedes carrier particles that might otherwise escape through the gap between the magnetic rolls 36 and 38 at either their inboard or outboard ends. A similarly shaped magnetic field generated by magnet center at the other end of the magnetic rolls likewise impedes the emission of carrier particles at that end. In one embodiment of a magnet center, the base is approximately 6 mm thick, 10.5 mm tall, and 7.5 mm wide.

Figure 7:
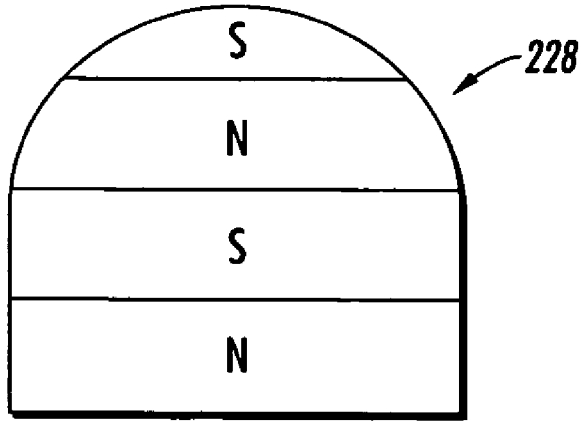
FIG. 7 is a perspective view of an exemplary embodiment of a magnet end showing one orientation of the poles for the magnetic materials used for the restrictor.

An exemplary embodiment of the magnet end 228 is shown in FIG. 7. The magnet end may be a U-shaped structure comprised of alternating magnetic pole material. The magnetic material may be designated with part number JPM-R2A, which is available from known sources for magnetic materials. Such material as the following properties: Br of 2300 to 2600 gauss, Hcb of 200-2300 Oe Hcj of 2400 or greater Oe, and BH Max of 1.3 to 1.5 MGOe. Although the magnet end is shown as having a northern pole at the base and a southern pole at the peak, other arrangements of the magnet material may be arranged differently. As noted above, the magnet end 228 may be oriented differently with respect to magnet center 224 for the outboard cap than the magnet end 228 is oriented with respect to magnet center 224 for the inboard cap to accommodate space restraints or other parameters. In one embodiment of the magnet end, the base is 8.7 mm wide, 0.7±0.2 mm thick, and 9 mm tall. The poles of this embodiment were spaced at 2.5 mm apart.

During assembly of an electrostatographic imaging machine, the arcurate structures in the inboard and outboard caps are fitted with magnet seal material to seal the ends of the rollers as is well-known. Additionally, the flanges 210 and 310 have magnet holders 218 and 318 mounted to them. The magnet centers 224 are snap fitted into the magnet holders 218 and 318, respectively. The magnet ends 228 are mounted to the magnet centers 224 as depicted above for the inboard and outboard caps. The outboard cap 200 and the inboard cap 300 are then mounted by screws or other mechanical fasteners at the outboard and inboard ends of the magnet rolls 36 and 38 to position the magnet ends proximate the gap between the rollers at the ends of the gap. As shown above, the magnet centers 224 and the magnet ends 228 generate magnetic fields that cover the ends of the gap between the magnet rolls 36 and 38. Consequently, as carrier particles translate outwardly in this gap, they encounter the magnetic field and their movement is impeded. As subsequent carrier particles build on the halted particles, a mechanical barrier to the further migration of carrier particles from the gap is formed. Thus, the magnet centers and ends form a magnetic restrictor that generates magnetic fields that effectively close the ends of the gap between the magnetic rollers and help ensure that carrier particles remain within the development station 100 rather than contaminate the interior of the electrostatographic imaging machine.

The embodiment described above has been discussed with regard to an arrangement for restricting the gap between two vertically arranged magnet rolls to reduce the loss of carrier particles from a development station. The components may also be adapted to magnetically restrict flow from a gap between other magnetic roll arrangements used to develop toner on moving photoreceptors. Of course for other magnetic roll arrangements, the structure, shape, and magnetic materials may be adapted to block any gap between the rolls in any suitable way. Therefore, the claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A development station for an electrostatographic printing machine, comprising:

a developer housing, for retaining a quantity of developer having semi-conductive carrier particles and toner particles;

a first magnetic roll having a stationary core with at least one magnet and a sleeve having longitudinal grooves that rotates about the stationary core of the first magnetic roll to present developer on one side of the first magnetic roll to the photoreceptor;

a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls; and a magnetic restrictor located proximate the gap between the first and the second magnetic rolls, the magnetic restrictor generates magnetic fields in the gap to impede the outflow of carrier particles from the developer moving from the first magnetic roll to the second magnetic roll.

2. The development station of claim 1, the magnetic restrictor comprising:

an inboard magnetic restrictor mounted in a portion of the gap between a set of ends of the first and the second magnetic rolls; and an outboard magnetic restrictor mounted in a portion of the gap between another set of ends of the first and the second magnetic rolls.

3. The development station of claim 2, further comprising:

an inboard cap to cover the set of ends of the first and the second magnetic rolls; and a magnet restrictor holder coupled to the inboard cap, the magnet restrictor holder securing the inboard magnetic restrictor in the gap between the set of ends of the first magnetic roll and the second magnetic roll.

4. The development station of claim 3, further comprising:

an outboard cap to cover the other set of ends of the first and the second magnetic rolls; and an outboard magnet restrictor holder coupled to the outboard cap, the magnet restrictor holder securing the outboard magnetic seal in the gap between the other set of ends of the first magnetic roll and the second magnetic roll.

5. The development station of claim 4 wherein the magnet restrictor holder snap fits to the inboard cap; and the outboard restrictor holder snap fits to the outboard cap.

6. The development station of claim 5, each of the inboard magnetic restrictor and the outboard magnetic restrictor include a magnet center and a magnet end.

7. The development station of claim 6, each of the magnet ends are U-shaped.

8. The development station of claim 6 wherein the magnet end for the inboard magnetic restrictor is parallel to the magnet center.

9. The development station of claim 6 wherein the magnet end for the outboard magnetic restrictor is perpendicular to the magnet center.

10. The development station of claim 2, further comprising:

an outboard cap to cover the other set of ends of the first and the second magnetic rolls; and a magnet restrictor holder coupled to the outboard cap, the magnet restrictor holder securing the outboard magnetic seal in the gap between the other set of ends of the first magnetic roll and the second magnetic roll.

11. An electrostatographic printing machine comprising:

a photoreceptor;

a raster output scanner (ROS) that generates a latent image on a portion of the photoreceptor as it moves past the ROS;

a development subsystem for developing toner on the latent image;

a transfer station for transferring the developed toner to a substrate;

a fusing station for fixing the transferred toner to the substrate; the development station further comprising:

a developer housing, for retaining a quantity of developer having semiconductive carrier particles and toner particles;

a first magnetic roll having a stationary core with at least one magnet and a sleeve having longitudinal grooves that rotates about the stationary core of the first magnetic roll to present developer on one side of the first magnetic roll to the photoreceptor;

a second magnetic roll having a stationary core with at least one magnet and a sleeve having longitudinal grooves that rotates about the stationary core of the second magnetic roll to receive developer from the first magnetic roll and present developer on one side of the second magnetic roll to the photoreceptor, the second magnetic roll being vertically displaced from the first magnetic roll so that a gap exists between the first and the second magnetic rolls; and a magnetic restrictor located proximate the gap between the first and the second magnetic rolls, the magnetic restrictor generates magnetic fields in the gap to impede the outflow of carrier particles from the gap at the first magnetic roll end and the second magnetic roll end.

12. The machine of claim 11, the magnetic seal comprising:

an inboard magnetic restrictor mounted in a portion of the gap at a set ends of the first and the second magnetic rolls; and an outboard magnetic restrictor mounted in a portion of the gap at another set of ends of the first and the second magnetic rolls.

13. The machine of claim 12, the development station further comprising:

an inboard cap to cover the set of ends of the first and the second magnetic rolls; and a magnet restrictor holder coupled to an inboard cap, the magnet restrictor holder securing the inboard magnetic restrictor proximate the gap at the set of ends of the first magnetic roll and the second magnetic roll.

14. The machine of claim 13, the development station further comprising:

an outboard cap to cover another set of ends of the first and the second magnetic rolls;

an outboard magnet restrictor holder coupled to the outboard cap, the magnet restrictor holder securing the outboard magnetic restrictor proximate the gap at the other set of ends of the first magnetic roll and the second magnetic roll.

15. The machine of claim 14 wherein the magnet restrictor holder snap fits to the inboard cap; and the outboard seal holder snap fits to the outboard cap.

16. The machine of claim 15, each of the inboard magnetic restrictor and the outboard magnetic restrictor include a magnet center and a magnet end.

17. The machine of claim 16 wherein the magnet end for the inboard magnetic restrictor is parallel to the magnet center.

18. The machine of claim 17 wherein the magnet end for the outboard magnetic restrictor is perpendicular to the magnet center.

19. A magnetic restrictor for a development station in an electrostatographic imaging machine comprising:

a magnet restrictor holder for coupling to a cap that covers an end of a magnetic roller;

a magnetic restrictor having a magnet center and a magnet end, the magnet restrictor holder positioning the magnetic restrictor proximate a gap between a first and a second magnetic roll so the magnetic restrictor generates magnetic fields in the gap to impede the outflow of carrier particles from the gap at the first magnetic roll end and the second magnetic roll end.

20. The magnetic restrictor of claim 19 wherein the magnet end for the magnetic restrictor is parallel to the magnet center.

21. The magnetic restrictor of claim 20 wherein the magnet end for the magnetic restrictor is perpendicular to the magnet center.

* * * * *